US007780422B2

(12) United States Patent
Berroth

(10) Patent No.: US 7,780,422 B2
(45) Date of Patent: Aug. 24, 2010

(54) ASSEMBLY FOR TRANSPORTING FLUIDS

(75) Inventor: Hansjörg Berroth, Obereschach (DE)

(73) Assignee: EBM-Papst St. Georgen GmbH & Co. KG, St. Georgen (DE)

( * ) Notice: Subject to any disclaimer, the term of this patent is extended or adjusted under 35 U.S.C. 154(b) by 806 days.

(21) Appl. No.: 11/576,881

(22) PCT Filed: Sep. 2, 2005

(86) PCT No.: PCT/EP2005/009443

§ 371 (c)(1),
(2), (4) Date: Apr. 6, 2007

(87) PCT Pub. No.: WO2006/039965

PCT Pub. Date: Apr. 20, 2006

(65) Prior Publication Data

US 2008/0038126 A1 Feb. 14, 2008

(30) Foreign Application Priority Data

Oct. 7, 2004 (DE) ..... 20 2004 015 933 U

(51) Int. Cl.
*F04B 17/03* (2006.01)
*H02K 49/00* (2006.01)

(52) U.S. Cl. ..... 417/420; 417/423.5; 310/103

(58) Field of Classification Search ..... 417/420, 417/423.5; 310/103, 104, 114, 80
See application file for complete search history.

(56) References Cited

U.S. PATENT DOCUMENTS 3,901,620 A 8/1975 Boyce ..... 415/1
3,930,742 A 1/1976 Boyce ..... 415/1
4,205,941 A 6/1980 Fradin ..... 415/1
6,600,649 B1 7/2003 Tsai et al. ..... 361/697

(Continued)

FOREIGN PATENT DOCUMENTS

DE 24 48 841 4/1975

(Continued)

OTHER PUBLICATIONS

Pat. Abs. of Japan, abstracting JP 09-163 675, Jodosha Denki Kogyo, publ. Oct. 31, 1997.

*Primary Examiner*—Charles G Freay
(74) *Attorney, Agent, or Firm*—Oliver I.P. LLC; Milton Oliver

(57) ABSTRACT

An arrangement for pumping fluids has an electronically commutated external-rotor motor. The latter has a stator arranged on a stator carrier and a rotor joined to a first permanent magnet, which rotor is rotatably journaled, in a bearing tube, with respect to the stator. This bearing tube is arranged, at least partly, radially inside the stator carrier. The first permanent magnet is arranged in an annular interstice between the stator carrier and the bearing tube. A fluid pump has a pump wheel arranged rotatably inside a pump housing, which wheel is joined to a second permanent magnet, a liquid-tight but magnetically transparent partition being provided between the first permanent magnet and the second permanent magnet. This keeps fluid away from the motor wiring. The first permanent magnet forms, by coaction with the second permanent magnet, a magnetic coupling to the fluid pump, which magnetic coupling automatically produces a rotation of the pump wheel as a result of rotation of the motor rotor.

19 Claims, 5 Drawing Sheets

U.S. PATENT DOCUMENTS

| | | | | |
|---|---|---|---|---|
| 7,391,140 | B2 * | 6/2008 | Horng et al. | 310/90 |
| 7,438,120 | B2 * | 10/2008 | Hong et al. | 165/80.4 |
| 2005/0287022 | A1 * | 12/2005 | Yaegashi et al. | 417/420 |
| 2006/0032625 | A1 | 2/2006 | Angelis et al. | 165/247 |

FOREIGN PATENT DOCUMENTS

| | | | |
|---|---|---|---|
| DE | 36 30 921 | | 3/1988 |
| DE | 297 07 440 | U | 6/1997 |
| DE | 103 44 699 | A | 4/2004 |
| WO | WO 2004-031588 | A | 4/2004 |

* cited by examiner

ASSEMBLY FOR TRANSPORTING FLUIDS

CROSS-REFERENCE

This application is a section 371 of PCT/EP05/09443, filed 2 Sep. 2005.

FIELD OF THE INVENTION

The present invention relates to an arrangement for pumping fluids. As fluids, liquid and/or gaseous media can be pumped.

BACKGROUND

In computers, components having high heat flux densities (e.g. 60 W/cm$^2$) are in use today. These components must be cooled with suitable cooling arrangements, in order to prevent thermal destruction of the components.

In cooling arrangements of this kind, dissipation of heat from these components is accomplished by means of so-called "heat absorbers" or "cold plates." In these, heat is transferred to a cooling liquid, to which a forced circulation in a circulation system is usually imparted. In this context, the cooling liquid flows not only through the heat absorber, but also through a liquid pump that produces the forced circulation and produces an appropriate pressure buildup and appropriate volumetric flow through the heat absorber and through an associated liquid/air heat exchanger. The liquid/air heat exchanger serves to discharge heat from the cooling liquid to the ambient air. A fan is usually arranged for this purpose on the liquid/air heat exchanger, which fan produces, on the air side of the heat exchanger, a forced convection of the cooling air, as well as good transfer coefficients.

Because of the limited installation space available in computers, and the consequent high integration density of components arranged therein, a compact design for such cooling arrangements is desirable.

SUMMARY OF THE INVENTION

It is therefore an object of the present invention to make available a novel arrangement for delivering fluids.

The object of the present invention is achieved in particular by an arrangement in which a first permanent magnet, forming part of an electronically commutated external-rotor motor, is arranged in an interstice between a stator carrier and a bearing tube, and the first permanent magnet couples magnetically to a second permanent magnet, located on an opposite side of a magnetically transparent fluid-tight partition, the second permanent magnet forming part of a rotor of a fluid pump, so that rotation of the first permanent magnet effectively causes a wheel of the fluid pump to rotate in the same rotational direction. In accordance therewith, an arrangement for delivering fluids encompasses an electronically commutated external-rotor motor having a stator arranged on a stator carrier and having a rotor journaled in a bearing tube, as well as a fluid pump having a pump wheel. The rotor of the electronically commutated external-rotor motor and the pump wheel of the fluid pump are magnetically coupled to one another via a magnetic coupling, in such a way that a rotation of the rotor produces a rotation of the pump wheel. This magnetic coupling is constituted by a first permanent magnet joined to the rotor, in coaction with a second permanent magnet joined to the pump wheel. At least the first permanent magnet is arranged in an interstice between the stator carrier and the bearing tube, and is separated from the second permanent magnet by a liquid-tight but magnetically transparent partition.

A very compact arrangement with a high level of integration and good efficiency, in particular at low and moderate rotation speeds, is thereby obtained; the placement of the first permanent magnet in the interstice between the stator carrier and the bearing tube allows a low overall height to be achieved.

A preferred refinement of the arrangement is to place the first permanent magnet radially between a bearing tube of the motor rotor and the fluid-tight partition, and to place the second permanent magnet radially between the fluid-tight partition and a stator of the motor.

In accordance therewith, the second permanent magnet can likewise be arranged in the interstice between the stator carrier and the bearing tube. This enables a further reduction in overall height and an increase in the integrity of the unit made up of the external-rotor motor, magnetic coupling, and fluid pump.

A further preferred refinement of the arrangement according to the present invention is form the bearing tube, the fluid-tight partition, and a stator carrier as one meander-shaped, integrally-formed part, with one end of the partition joining the bearing tube and the other end of the partition joining the stator carrier.

In accordance therewith, the bearing tube, partition, and stator carrier can be implemented as an integral part that is meander-shaped in cross section. This allows the parts count to be minimized, and assembly of the arrangement thus to be simplified.

BRIEF FIGURE DESCRIPTION

Further details and advantageous refinements of the invention are evident from the exemplifying embodiments, in no way to be understood as a limitation of the invention, that are described below and depicted in the drawings. In the drawings.

Figure 1:
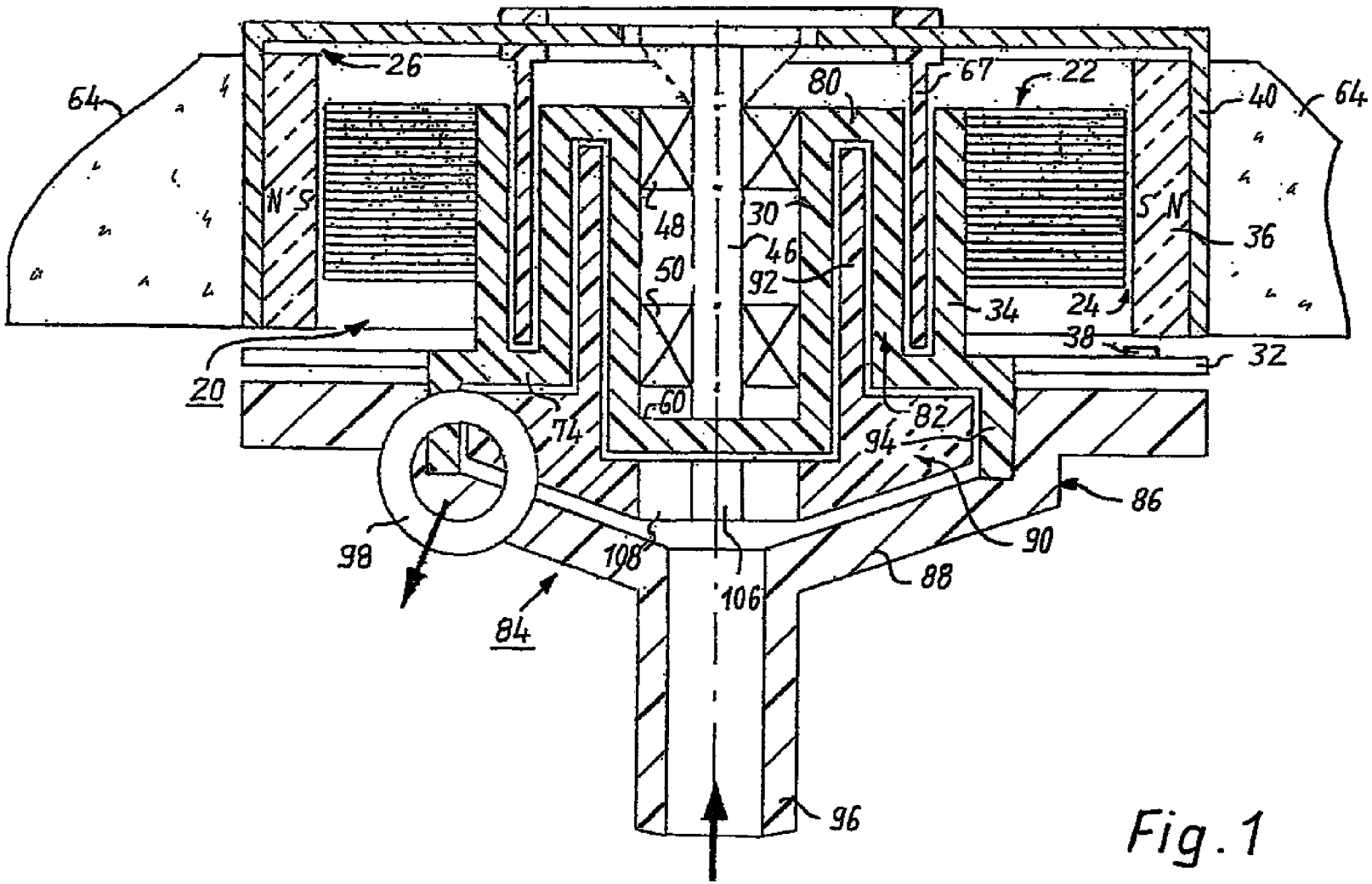
FIG. 1 is a longitudinal section through a first preferred embodiment of an arrangement according to the invention for delivering fluids.

In the description that follows, the terms "left," "right," "top," and "bottom" refer to the respective figure of the drawings, and can vary from one figure to the next as a function of a particular orientation (portrait or landscape) that is selected. Identical or identically functioning parts are labeled with the same reference characters in the various figures, and usually are described only once.

DETAILED DESCRIPTION

FIG. 1 is an enlarged sectioned depiction of a first embodiment of an arrangement having a fluid pump 84 that is depicted by way of example as a centrifugal pump, and having an electronically commutated external-rotor motor 20. The latter has an internal stator 22 of conventional design, as depicted by way of example in FIG. 2, e.g. a stator having salient poles or a claw-pole stator, and the latter is separated by a substantially cylindrical air gap 24 from a permanent-magnet external rotor 26. External rotor 26 rotates around internal stator 22 during operation, and such motors 20 are therefore referred to as "external-rotor" motors.

Internal stator 22 is mounted on an annular stator carrier 34, usually by being pressed on. The shape of stator carrier 34 is particularly clearly evident from FIG. 2. Located below internal stator 22 in FIG. 1 is a circuit board 32. Located on the latter are, for example, electronic components (not depicted here) that are required for electronic commutation of motor 20. Also arranged on circuit board 32 is a rotor position sensor 38 that is controlled by rotor magnet 36 of external rotor 26. This rotor magnet 36 is implemented as a permanent ring magnet and preferably comprises plastic-matrix magnet material. Rotor magnet 36 is furthermore radially magnetized and preferably implemented with eight poles. Its magnetization, i.e. the distribution of its magnetic flux density, can be, for example, rectangular or trapezoidal. Rotor position sensor 38 is controlled by a leakage field of rotor magnet 36, which enables non-contact sensing of the position of external rotor 26.

External rotor 26 has a design with a so-called rotor cup 40, which is depicted in FIG. 1 by way of example as a deep-drawn cup-shaped sheet-metal part and is implemented, for example, from a soft ferromagnetic material. Rotor magnet 36 is mounted in this rotor cup 40, so that the latter forms a magnetic yoke for rotor magnet 36.

Fan blades 64 are depicted, by way of example, on the outer side of rotor cup 40. For this purpose, rotor cup 40 is by preference surrounded by a plastic part (not depicted; cf. FIG. 5) on which said fan blades 64 are implemented, in the manner depicted, by plastic injection molding. During operation, fan blades 64 rotate in an opening of a fan housing. A corresponding fan housing is explained below with reference to FIG. 3.

A shaft 46 is mounted in rotor cup 40 in the manner depicted. Shaft 46 is journaled in two ball bearings 48, 50 that, for example, during assembly are pressed from above (in FIG. 1), together with shaft 46, into a bearing tube 30. Ball bearings 48, 50 can be held in the bearing tube by suitable holding elements, e.g. a latching member. Shaft 46 can likewise be held by suitable holding elements, e.g. by a snap ring, in ball bearings 48, 50 that are pressed into bearing tube 30.

Figure 2:
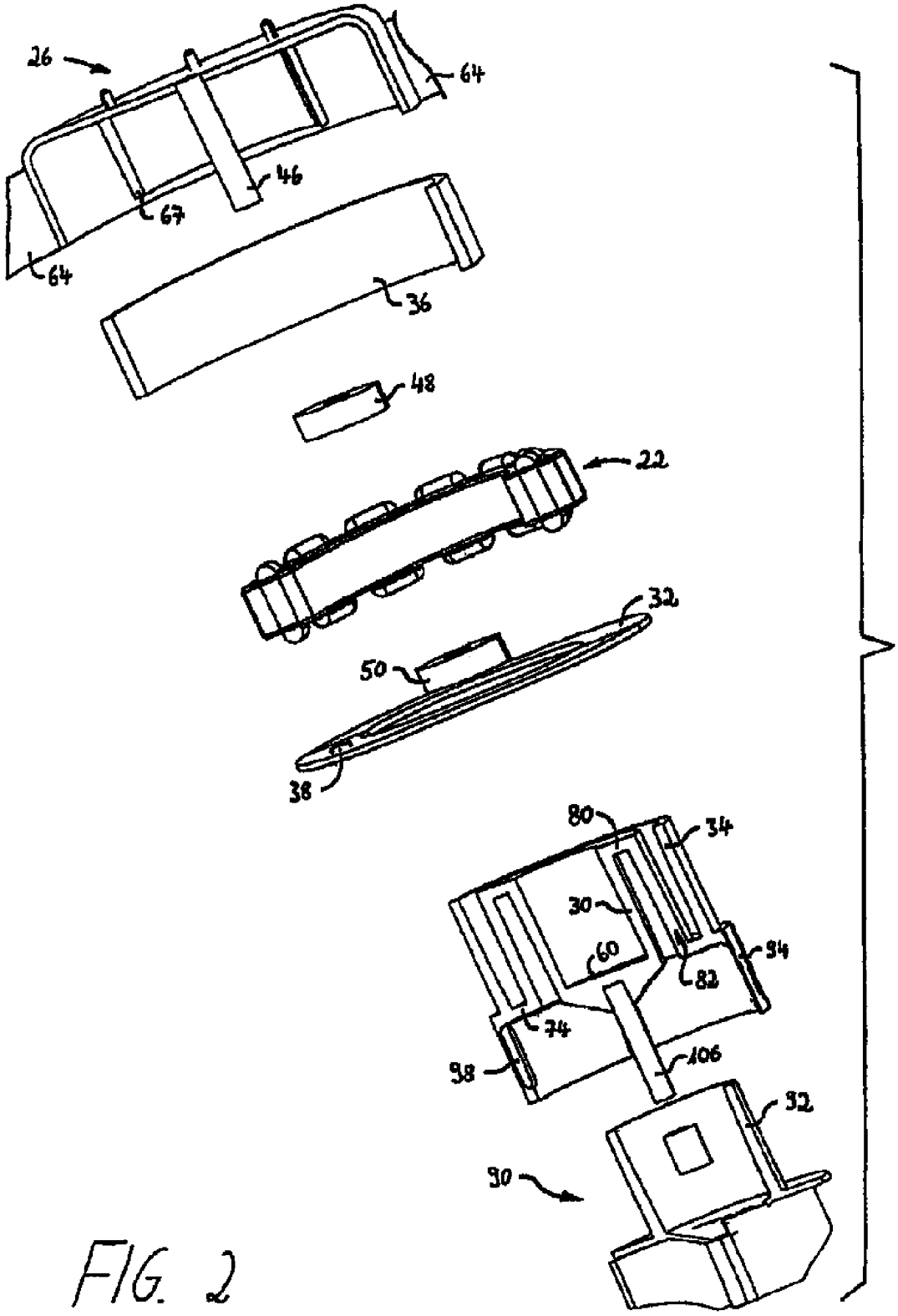
FIG. 2 is an exploded view of the arrangement according to FIG. 1.

The installation of shaft 46 with ball bearings 48, 50 in bearing tube 30 is particularly clearly evident from FIG. 2. This installation can be of course be accomplished in many ways, and is thus not limited to a specific assembly procedure. It is noted, however, that the assembly procedure described in the context of FIG. 1 allows shaft 46 of external rotor 26, together with the previously preassembled ball bearings 48, 50, to be installed from above in bearing tube 30, so that end 60 (depicted at the bottom in FIG. 1) of the internal opening of bearing tube 30 can be closed or sealed off in hermetic or liquid-tight fashion (cf. FIG. 2) in this context.

Implemented between bearing tube 30 and stator carrier 34 is an interstice in which a so-called "driving" magnet 67 is arranged. This driving magnet 67 provides drive in a magnetic coupling, and in FIGS. 1 and 2 is implemented annularly and joined fixedly to rotor cup 40. Driving magnet 67 comprises plastic-matrix magnet material, e.g. plastic material having embedded particles of hard ferrite, and is manufactured by plastic injection molding. A permanent magnet manufactured in this fashion is also referred to as a "plastic-matrix ferrite" magnet, and can also be used to implement rotor magnet 36. Rotor magnet 36 can be mounted on rotor cup 40 by plastic injection molding. An alternative as rotor magnet 36 is that a hard ferrite ring magnet could also be mounted separately on rotor cup 40, e.g. by adhesive bonding or by being pressed on, or individual magnets made of rare earths, e.g. neodymium, could be used.

In FIG. 1, driving magnet 67 is separated by an annular partition 82 from a so-called "driven" magnet 92 that is, so to speak, "driven" upon rotation of driving magnet 67 when the magnetic coupling is in operation, and that is arranged, in cross section, parallel to driving magnet 67. This partition 82 is implemented in liquid-tight and magnetically transparent fashion, e.g. from plastic. As depicted, the upper end of annular partition 82 is joined in liquid-tight fashion, via an annular flange 80, to the upper end of bearing tube 30. The lower end of partition 82 is furthermore joined in liquid-tight fashion, via an annular flange 74, to the lower end of annular stator carrier 34. Annular flanges 80 and 74 each extend perpendicular to the rotation axis of external rotor 26. Bearing tube 30, flange 80, partition 82, flange 74, and stator carrier 82 thus form a part that is meander-shaped in cross section, and that is implemented in the region of driven magnet 92 as a partitioning can. According to a preferred embodiment, this partitioning can is integrally formed and is manufactured e.g. from plastic.

The partitioning can transitions, via the outer periphery of annular flange 74, into a cylindrical portion 94 that, as depicted, serves for mounting a cover 88 in order to form therewith a liquid-tight pump housing 86. Cover 88 can be mounted on cylindrical portion 94, for example, by means of a screw attachment (not shown), a sealing ring (not shown), or by laser welding. Provided on cover 88 is an inlet 96 through which a fluid can travel into pump housing 86, which fluid can emerge from pump housing 86 via a schematically depicted outlet 98.

A pump wheel 90 is provided in the interior space of pump housing 86 to constitute fluid pump 84. In FIG. 1, pump wheel 90 is arranged on a pump shaft 106 that is aligned along a (geometric) axial projection of shaft 46 of external rotor 26. The two shafts are separated from one another in liquid-tight fashion by end 60 of the inner opening of bearing tube 30, which end is closed off in liquid-tight fashion.

Pump shaft 106 forms a stationary axle on which pump wheel 90 in FIG. 1 is journaled rotatably relative to the axle in a centrifugal bearing assembly 108. Centrifugal bearing assembly 108 is preferably implemented as so-called "hybrid" bearings. These hybrid bearings have balls made of ceramic, and bearing assemblies made of a corrosion-resistant stainless steel alloy. They are manufactured, for example, by the GRW company and are used in particular for blood pumps and dental drills. With such bearings, the desired service life is obtained, even in unusual fluids.

As an alternative to the stationary axle, it is possible to provide a rotating shaft for the journaling of pump wheel 90. This shaft, just like shaft 46 of external rotor 26, is journaled in a bearing tube (not depicted) that is then, like bearing tube 30, implemented integrally with the partitioning can and protrudes downward therefrom, i.e. in mirror-image fashion to bearing tube 30.

Pump wheel 90 is preferably implemented integrally with the driven magnet 92 that, by coaction with driving magnet 67, forms the magnetic coupling; in other words, when driving magnet 67 rotates, driven magnet 92 also rotates and thereby drives pump wheel 90, with the result that the latter draws in a fluid through inlet 96 and pumps it back out through outlet 98, as indicated by arrows. Liquid media, e.g. cooling liquids, and/or gaseous media can be utilized as fluids. Furthermore, any desired other hydraulic machine, e.g. a compressor for a coolant, can be provided, instead of a pump.

In FIG. 1, the magnetic coupling is constituted by a linkage of the radial magnetic fields of driving magnet 67 and of driven magnet 92. For illustrative purposes, this magnetic coupling is therefore referred to hereinafter as a "radial" magnetic coupling.

FIG. 2 is an exploded view of the arrangement of FIG. 1, in which cover 88 of pump housing 86 is not depicted. FIG. 2 shows particularly clearly the integral configuration, with a meander-shaped cross section, of bearing tube 30, flange 80, partition wall 82, flange 74, and stator carrier 34. The design of internal stator 22 and the integral configuration of pump wheel 90 with driven magnet 92 are moreover illustrated in FIG. 2.

Figure 3:
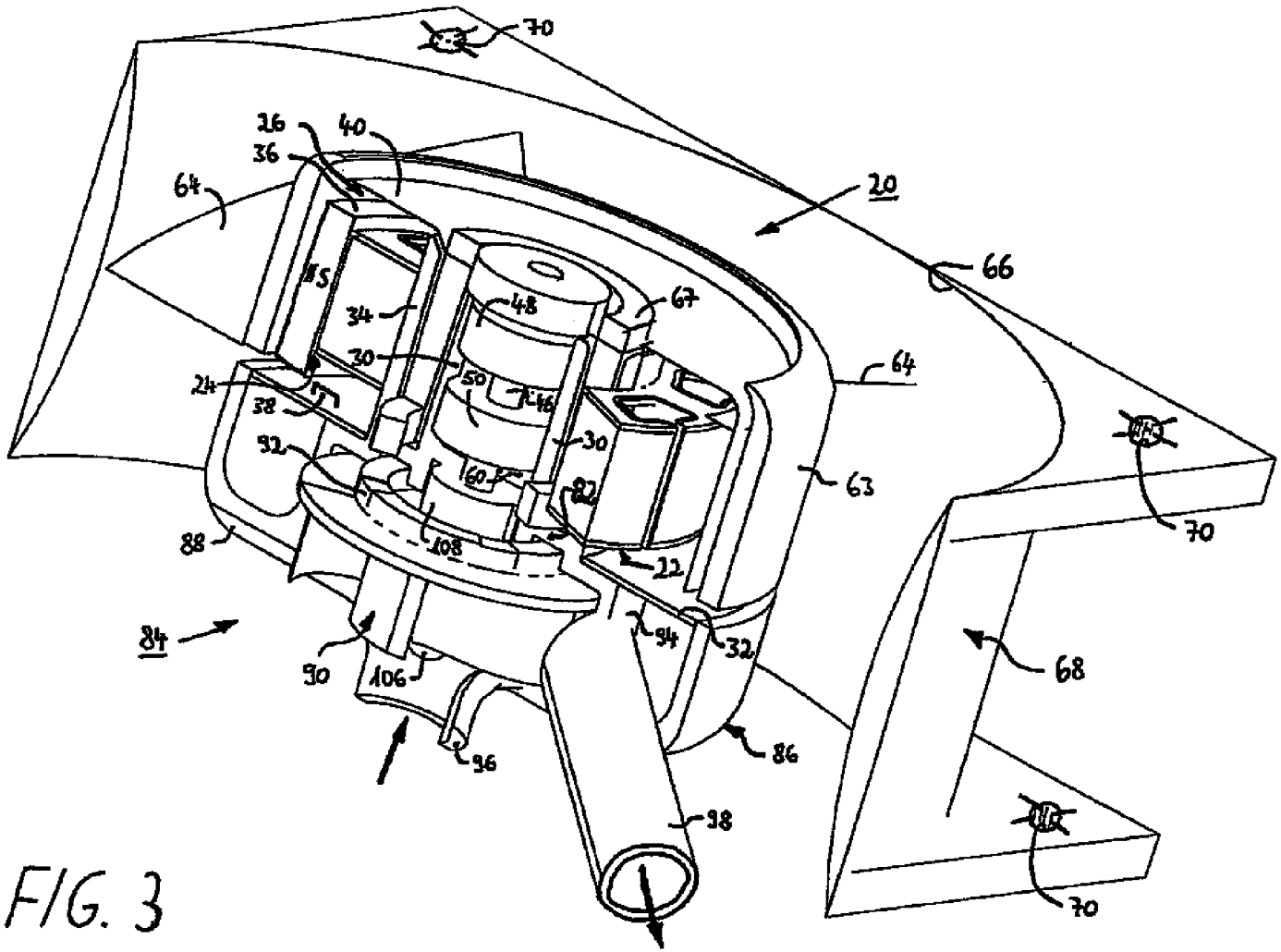
FIG. 3 is a sectioned view of a three-dimensional depiction of a second preferred embodiment of an arrangement according to the invention for delivering fluids.

FIG. 3 shows, in an enlarged three-dimensional sectioned depiction, a second embodiment of the arrangement for delivering fluids, with fluid pump 84 and with an electronically commutated external-rotor motor 20 that differs slightly from that of FIG. 1. This arrangement is mounted, by way of example, in an opening 66 of a fan housing 68, in which opening, during operation, fan blades 64 of electronically commutated external-rotor motor 20 rotate (cf. FIGS. 4 and 5). Fan housing 68 has, for example, the usual square shape of an equipment fan, and has a mounting hole 70 at each of its corners.

In contrast to FIG. 1, in FIG. 3 rotor cup 40 is surrounded, as depicted, by a plastic part 63 on which fan blades 64 are formed by plastic injection molding in the manner depicted. In addition, partition 82 is arranged, not between bearing tube 30 and stator carrier 34, but at their lower ends. Driven magnet 92 is thus arranged, in cross section, not parallel to driving magnet 67 but instead on a (geometric) axial projection thereof.

Figure 5:
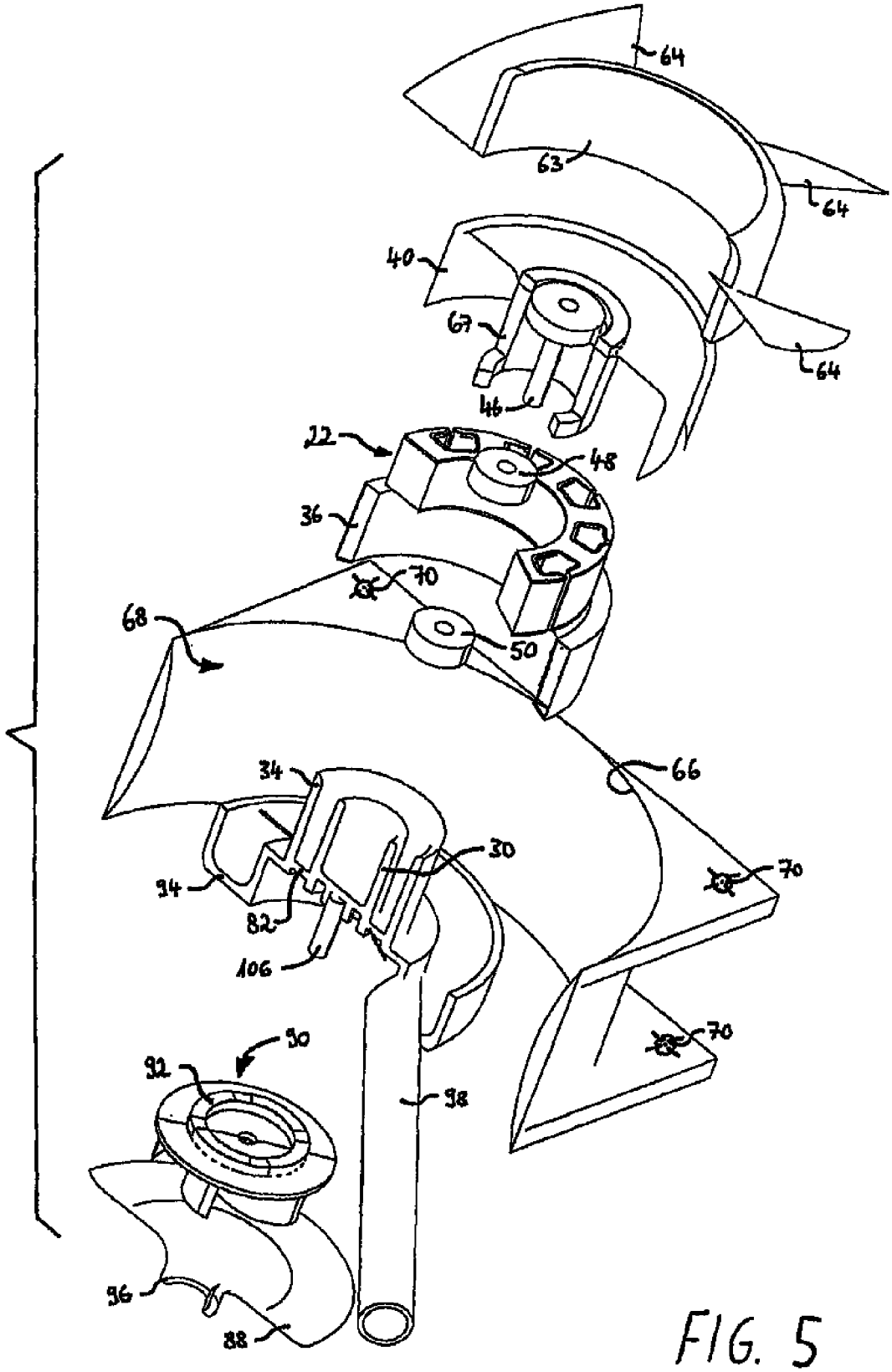
FIG. 5 is an exploded view of the arrangement according to FIG. 3.

As is particularly clearly evident from FIG. 5, in the second embodiment, partition 82 forms an annular flange between the lower end of bearing tube 30 and the lower end of stator carrier 34, which are joined to one another in liquid-tight fashion by partition 82 and constitute a partitioning can in the region of driven magnet 92. This partitioning can is preferably manufactured integrally and, for example, from plastic, and transitions via the outer periphery of the annularly configured partition 82 into cylindrical portion 94, which latter in turn serves for the mounting of cover 88. Cylindrical portion 94 is depicted in FIG. 3, by way of example, in streamlined form as a flow-optimizing channel.

Because driven magnet 92 is arranged on an axial projection of driving magnet 67, the magnetic coupling is formed by a linkage of the axial magnetic fields of these permanent magnets. This magnetic coupling is therefore referred to hereinafter, for illustrative purposes, as an "axial" magnetic coupling. In order to ensure unhindered functionality of this axial magnetic coupling, a permanent magnet having a strong axial magnetic field, e.g. a rare-earth magnet, is preferably used for driven magnet 92.

Figure 4:
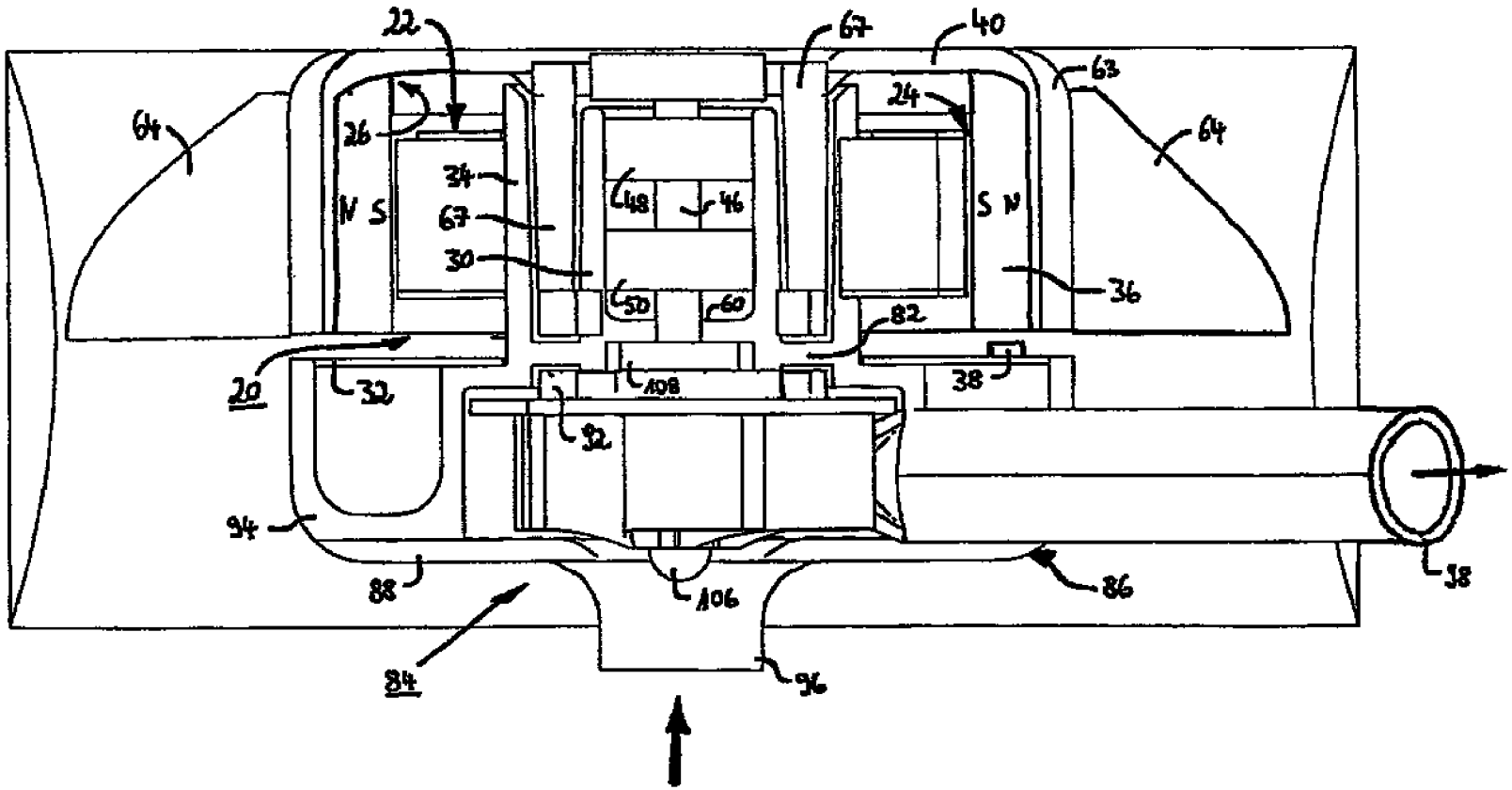
FIG. 4 is a longitudinal section through the arrangement according to FIG. 3.

FIG. 4 is a longitudinal section through the arrangement of FIG. 3, in which section the implementation of external rotor 26 with rotor cup 40 and with rotor magnet 36 is clearly visible.

FIG. 5 is an exploded view of the arrangement of FIG. 5, in which view, in particular, the integral implementation of the partitioning can and the flow-optimizing configuration of cylindrical portion 94 are visible.

Operation

In operation, external-rotor 20 forms, along with external rotor 26, a fan whose fan blades 64 rotate in fan housing 68. In FIGS. 1 to 5, this fan is depicted by way of example as an axial fan that, upon rotation of fan blades 64, generates an axial air flow in known fashion. Alternatively, the fan can also be implemented, for example, as a diagonal fan or radial fan. The fan design that is used depends on the particular requirements that should be satisfied.

Upon rotation of external rotor 26, driving magnet 67 (which may be magnetized, for example, with six or eight poles) is also rotated. Driving magnet 67 drives driven magnet 92, which in this case is likewise magnetized with six or eight poles, and causes it also to rotate. If driving magnet 67 rotates, for example, counterclockwise, driven magnet is consequently also rotated by the magnetic coupling counterclockwise at the same speed. The arrangement depicted in FIGS. 1 to 5 thus operates on the principle of a synchronous motor. Alternatively, operation with slippage is also possible.

As a result of the imposed rotation of driven magnet 92, pump wheel 90 is also rotated, so that the latter draws in a corresponding fluid through inlet 96 and pumps it back out through outlet 98. An arrangement of this kind can be used, for example, in a water fountain, in order to draw in water and pump it out, or to pump blood in a heart-lung machine, or to transport a cooling liquid in a closed cooling circuit, in which case pump wheel 90 then has the function of a circulating pump.

Because cover 88 is hermetically connected or joined in liquid-tight fashion, e.g. by laser welding, to cylindrical portion 94, when a liquid is delivered out of pump housing 86, said liquid cannot escape to the outside. Contributing to this is the fact that portion 94 has no orifices of any kind. This is possible because electronically commutated external-rotor motor 20 and fluid pump 84 can be assembled independently of one another and in a very simple and reliably processed manner (cf. FIGS. 2 and 5). When electronically commutated external-rotor motor 20 is installed, for example, it is not necessary to have access to end 60 of the inner opening of bearing tube 30, or to that side of the partitioning can on which fluid pump 84 is implemented. In particular, prior to the installation of external rotor 26, the entire remaining part of the arrangement can be pre-assembled. Pump wheel 90 of fluid pump 94, with its bearing assembly 108, can likewise be installed from below on the stationary pump shaft 106, before cover 88 is mounted.

As a result of the small physical distance between driving magnet 67 and driven magnet 92 in FIGS. 1 to 5, according to the present invention a strong magnetic coupling is constituted, and good efficiency for the arrangement is achieved, in particular at low and moderate rotation speeds. This small distance furthermore makes it possible to implement driven magnet 92 using a permanent magnet having a small diameter. This is important because driven magnet 92 rotates in the fluid, and low frictional losses consequently occur in that fluid when the diameter of driven magnet 92 is small. This contributes to the good efficiency of the arrangement. In addition, according to the present invention, a low overall height and a high degree of integration are achieved.

Numerous variants and modifications are of course possible within the scope of the present invention.

What is claimed is:

1. An arrangement for pumping fluids that comprises:

an electronically commutated external-rotor motor (20) having a stator (22) arranged on a stator carrier (34) and a rotor (26) joined to a first permanent magnet (67), which rotor is journaled in a bearing tube (30) rotatably relative to the stator, which bearing tube is arranged at least partly radially inside the stator carrier, the first permanent magnet (67) being arranged in an interstice between the stator carrier (34) and the bearing tube (30);

a fluid pump (84) having a pump wheel (90) arranged rotatably inside a pump housing (86), which wheel is joined to a second permanent magnet (92), a liquid-tight but magnetically transparent partition (82) being provided between the first permanent magnet and the second permanent magnet, and the first permanent magnet (67) forming, by coaction with the second permanent magnet (92), a magnetic coupling for the fluid pump (84), which magnetic coupling produces, upon rotation of the rotor (26), a rotation of the pump wheel (90) of the fluid pump (84).

2. The arrangement according to claim 1, wherein the first permanent magnet (67) is arranged between the stator carrier (34) and the partition (82), and the second permanent magnet (92) is arranged between the partition and the bearing tube (30).

3. The arrangement according to claim 1, wherein the first permanent magnet (67) and the second permanent magnet (92) are annular.

4. The arrangement according to claim 1, wherein the first permanent magnet (67) comprises plastic-matrix magnetic material.

5. The arrangement according to claim 4, wherein the first permanent magnet (67) is manufactured by plastic injection molding.

6. The arrangement according to claim 1, wherein the bearing tube (30), the partition (82), and the stator carrier (34) are manufactured from magnetically transparent material.

7. The arrangement according to claim 1, wherein one end of the bearing tube (30) is hermetically connected, via an annular flange (80), to one end of the partition (82).

8. The arrangement according to claim 7, wherein the pump housing (86) is hermetically connected to the other end of the partition (82), and is implemented, in the region of the second permanent magnet (92), as a partitioning can.

9. The arrangement according to claim 8, wherein the partitioning can is manufactured from a magnetically transparent material.

10. The arrangement according to claim 1, wherein the bearing tube (30), the partition (82), and the stator carrier (34) are manufactured as one integral part which is meander-shaped in cross section, in which part one end of the bearing tube is joined to one end of the partition, and the other end of the partition is joined to one end of the stator carrier.

11. The arrangement according to claim 10, wherein the integral part is manufactured from a magnetically transparent material.

12. The arrangement according to claim 10, wherein the pump housing (86) is hermetically connected to the other end of the partition (82), and is implemented, adjacent the second permanent-magnet (92), as a partitioning can.

13. The arrangement according to claim 1, wherein the electronically commutated external-rotor motor (20) comprises a rotor cup (40) inside which a rotor magnet (36) and the first permanent magnet (67) are arranged.

14. The arrangement according to claim 13, wherein fan blades (64) are arranged on the rotor cup (40).

15. The arrangement according to claim 13, wherein the rotor magnet (36) of said motor comprises plastic-matrix magnetic material.

16. The arrangement according to claim 1, wherein the pump wheel (90) of the fluid pump is joined to a stationary pump shaft (106) arranged in the pump housing, and rotates about said pump shaft, during operation.

17. The arrangement according to claim 16, wherein the pump shaft (106) is aligned along a geometric axial projection of a shaft (46) joined to the rotor (26), which shaft is rotatably journaled in the bearing tube (30), the two shafts being hermetically separated from one another.

18. The arrangement according to claim 1, wherein the first permanent magnet (67) comprises a plurality of permanent magnets embedded in plastic.

19. The arrangement according to claim 11, wherein the pump housing (86) is hermetically connected to the other end of the partition (82), and is implemented, adjacent the second permanent magnet (92), as a partitioning can.

* * * * *